US007902469B2

(12) United States Patent
Hurst

(10) Patent No.: US 7,902,469 B2
(45) Date of Patent: Mar. 8, 2011

(54) PERFORATION GUN PRESSURE-ACTUATED ELECTRICAL SWITCHES AND METHODS OF USE

(76) Inventor: Brian Wayne Hurst, Mineral Wells, TX (US)

( * ) Notice: Subject to any disclaimer, the term of this patent is extended or adjusted under 35 U.S.C. 154(b) by 426 days.

(21) Appl. No.: 12/229,951

(22) Filed: Aug. 28, 2008

(65) Prior Publication Data

US 2010/0051440 A1 Mar. 4, 2010

(51) Int. Cl.
*H01H 35/38* (2006.01)

(52) U.S. Cl. ..... 200/81 R; 200/82 R

(58) Field of Classification Search ..... 175/4.55, 175/4.56, 4.5, 2, 3.5, 4; 89/1.15; 166/55–55.8; 200/81 R, 81.4, 81.5, 81.8, 82 R, 82 B, 82 C, 200/82 A, 61.08

See application file for complete search history.

(56) References Cited

U.S. PATENT DOCUMENTS 2,381,081 A * 8/1945 Schlumberger ..... 175/4.55
4,007,796 A * 2/1977 Boop ..... 175/4.55
4,100,978 A * 7/1978 Boop ..... 175/4.55
4,234,768 A * 11/1980 Boop ..... 200/52 R
4,306,628 A * 12/1981 Adams et al. ..... 175/4.56
4,339,638 A * 7/1982 Lascelles et al. ..... 200/52 R
4,457,383 A * 7/1984 Boop ..... 175/4.55
4,852,494 A * 8/1989 Williams ..... 102/263
5,034,683 A * 7/1991 Takahashi et al. ..... 324/754.23
5,042,594 A * 8/1991 Gonzalez et al. ..... 175/4.55
6,035,880 A * 3/2000 Gazda ..... 137/68.16
6,220,370 B1 * 4/2001 Wesson et al. ..... 175/4.52

* cited by examiner

*Primary Examiner* — Michael A Friedhofer

(57) ABSTRACT

Pressure-actuated electrical switches are provided that comprise a housing having a slidable piston therein. The slidable piston slides from a first position to a second position and in so doing switches an electrical path from a first electrical contact and a second electrical contact to an electrical path between the first electrical contact and a third electrical contact. Suitable applications of such switches include any application in which a pressure wave is used to actuate an electrical switch. The pressure-actuated electrical switches of the present invention are especially adapted for use in controlling successive detonations in a downhole perforation gun, as explosive gases and pressure waves are used to actuate the slidable piston so as to trigger a subsequent detonation charge. Perforation guns utilizing these pressure-actuated electrical switches and corresponding methods of use are also provided herein.

33 Claims, 3 Drawing Sheets

PERFORATION GUN PRESSURE-ACTUATED ELECTRICAL SWITCHES AND METHODS OF USE

BACKGROUND

The present application relates to pressure actuated electrical switches. More particularly, methods and devices are provided for arming successive explosive charges upon actuation of a switch by pressure waves from previous detonations.

In oil and gas exploration and production operations, well bores are drilled into the ground to gain access to subsurface hydrocarbon-bearing formations or reservoirs. Well bores are typically lined with steel tubing, known as casing or liner, to provide the wellbore with a stable, permanent barrier. This casing is often secured to the wellbore by cement that is pumped into the annulus between the outside diameter of the casing and the inside diameter of the wellbore wall.

While the casing stabilizes the wellbore wall, it also seals the fluids within the earth strata. Thus, the casing must be opened or perforated to allow the inflow of hydrocarbons into the casing for extraction. To selectively open the casing to such fluid flow, the casing is often penetrated in the region of a fluid production zone by shaped or oriented charge explosives, which when detonated, penetrate the casing creating perforations through which fluid in the formation may flow. The tubular tool section that carries these explosives is often referred to as a "perforation gun" or more simply as a "gun."

Often, it is desired to perforate a casing at multiple locations to access hydrocarbons residing in multiple subterranean zones. To accomplish these perforations in the casing, charged explosives are typically used to penetrate the casing. The charged explosives are usually delivered by way of a tubular gun, typically referred to as a perforation gun.

Inadvertent activation of such explosives pose a potential hazard to personnel. Additionally, inadvertent firing of an perforation gun or self-detonation thereof while the gun is being positioned or retrieved can damage the wellbore, such as perforating the casing at an undesired depth. Moreover, explosives that fail to fire or for some reason are not fired must be retrieved from the wellbore in its unfired condition, creating a potential hazard to both personnel and the wellbore, not to mention the resulting lost operation time. Further complicating operation of these perforation guns is the requirement of creating multiple perforations at multiple depths. Plus, each perforation may require activation of a different number or set of explosives.

Accordingly, a variety of switching mechanisms have been designed to control activation of multiple explosives. U.S. Pat. No. 4,457,383 describes one example of a conventional switching unit. In devices of this type, a plurality of blasting cap-perforating element assemblages are spaced apart along the length of a perforation gun. The assemblage that is furthest downhole is typically armed, while the other successive assemblages are disarmed. When the armed assemblage is fired, the next adjacent assemblage closest to the discharged assemblage is armed through the use of a mechanically operated switch.

Thus, conventional switching units have been described that arm a subsequent charge upon a first charge being fired while, at the same time, disconnecting the firing mechanism from the first charge. This result is accomplished because the hot wire side of the firing circuit includes a switch for each initiator-perforating element assemblage which completes a bypass circuit to the next upper assemblage while disarming its associated assemblage. Upon firing the lowermost assemblage, the switch of the next upper assemblage is manipulated to arm its associated blasting cap. Firing of charges carried by the perforation gun may in this fashion proceed from the bottom of the gun toward the top of the perforation gun.

Generally, conventional switches of this type involve a "bullet" that is thrust axially in the switching mechanism by the explosive force of a preceding charge. The axial movement of the bullet is intended to disconnect the arming of the previously activated charge and at the same time, or immediately thereafter, engage the arming mechanism of a subsequent explosive charge. The disadvantages of such conventional switches are numerous, including malfunctions involving the bullet failing to move the desired axial distance or being propelled farther than its desired distance. Where the bullet is insufficiently propelled the desired axial distance, the bullet will not properly engage the arming mechanism of the subsequent explosive charge and thus fail to engage the subsequent explosive charge for activation. Additionally, the bullet, by failing to be propelled the desired axial distance will also fail to disconnect with the previously activated explosive charge. Where the bullet is propelled past its intended destination, on the other hand, it may fail to adequately engage the subsequent arming mechanism.

Additionally, because of the design limitations of conventional switching units, such switching units only effectively operate within a narrow range of temperatures and pressures. Therefore, such conventional switches frequently fail to operate outside of the narrow range of conditions for which they are designed. Moreover, fluid contamination in portions of the perforation gun may contaminate the arming mechanisms or switching units so as to prevent the proper operation thereof. For example, fluid within the above described prior art switch often has the effect of inhibiting the pressure mechanism used to propel the "bullet." Without sufficient force to propel the bullet, the mechanism will fail as described above.

Therefore, improved pressure actuated electrical switching devices are needed to address one or more disadvantages of the prior art.

SUMMARY

The present invention generally relates to devices and methods for coupling sections of electronic enclosures together through the use of a clamping belt.

An example of one embodiment of a switch for controlling detonations in a perforation gun comprises a housing; a pressure port extending into the housing; a piston disposed in the housing, the piston having a portion of its surface area exposed to the pressure port wherein the piston is configured to slide from a first position to a second position in the housing upon pressure being applied to the piston from the pressure port; a first electrical contact disposed at least partially in the housing such that the first electrical contact is in electrical contact with the piston when the piston is in the first position and when the piston is in the second position; a second electrical contact disposed at least partially in the housing such that the second electrical contact is in electrical contact with the piston when the piston is in the first position and not in electrical contact with the piston when the piston is in the second position; a third electrical contact disposed at least partially in the housing such that the third electrical contact is in electrical contact with the piston when the piston is in the second position and not in electrical contact with the piston when the piston is in the first position; wherein the piston is electrically conductive so as to allow current to flow from the first electrical contact to the second electrical contact or from the first electrical contact to the third electrical contact; and wherein the first electrical contact, the second electrical contact, and the third electrical contact are electrically conductive.

An example of one embodiment of an electrical switch actuated by pressure comprises a housing having a first end and a second end; a piston disposed in the housing slidable from a first position to a second position, the piston having a first end and a second end; a pressure port extending into the housing from the second end of the housing wherein the pressure port is at least partially exposed to the second end of the piston so as to cause the piston to slide from the first position to the second position upon an application of pressure to the second end of the piston; a first pin disposed at least partially in the housing such that the first pin is in electrical contact with the first end of the piston when the piston is in the first position and when the piston is in the second position; a second pin disposed at least partially in the housing such that the second pin is in electrical contact with the second end of the piston when the piston is in the first position and not in electrical contact with the piston when the piston is in the second position; a third pin disposed at least partially in the housing such that the third pin is in electrical contact with the first end of the piston when the piston is in the second position and not in electrical contact with the piston when the piston is in the first position; wherein the piston is electrically conductive so as to allow current to flow from the first pin to the second pin or from the first pin to the third pin; and wherein the first pin, the second pin, and the third pin are electrically conductive.

An example of one embodiment of a method for arming a charge upon detection of a pressure wave comprises providing a pressure switch comprising a housing, a pressure port extending into the housing, a piston disposed in the housing wherein the piston has a portion of its surface area exposed to the pressure port wherein the piston is configured to slide from a first position to a second position in the housing upon pressure being applied to the piston from the pressure port, a first electrical contact disposed at least partially in the housing such that the first electrical contact is in electrical contact with the piston when the piston is in the first position and when the piston is in the second position, a second electrical contact disposed at least partially in the housing such that the second electrical contact is in electrical contact with the piston when the piston is in the first position and not in electrical contact with the piston when the piston is in the second position, a third electrical contact disposed at least partially in the housing such that the third electrical contact is in electrical contact with the piston when the piston is in the second position and not in electrical contact with the piston when the piston is in the first position wherein the piston is electrically conductive so as to allow current to flow from the first electrical contact to the second electrical contact or from the first electrical contact to the third electrical contact, and wherein the first electrical contact, the second electrical contact, and the third electrical contact are electrically conductive; detonating an explosive charge to generate a pressure wave; directing said pressure wave through said pressure port; and utilizing the directed pressure wave to slide the piston from the first position to the second position so as to disengage electrical contact between the first electrical contact and the second electrical contact and to engage electrical contact between the first electrical contact and the third electrical contact.

An example of one embodiment of a switch for controlling detonations in a perforation gun comprises a housing; a first non-conductive insert in which a piston cylinder is formed, said cylinder having a first end and a second end; a piston slidingly disposed in said piston cylinder and movable from a first position adjacent the first end to a second position adjacent the second end; a second non-conductive insert in which a pressure port is defined, said first and second inserts disposed in the housing so that the pressure port is in fluid communication with the piston cylinder; a first electrical contact adjacent the piston cylinder; a second electrical contact adjacent the first end of the piston cylinder; a third electrical contact adjacent the second end of the piston cylinder; wherein the piston is electrically conductive so as to allow current to flow from the first contact to the second contact or from the first contact to the third contact.

An example of one embodiment of a perforating gun comprises a first blasting cap; a second blasting cap; and a switch disposed between said blasting caps, said switch comprising a switch housing; a first non-conductive insert in which a piston cylinder is formed, said cylinder having a first end and a second end; a piston slidingly disposed in said piston cylinder and movable from a first position adjacent the first end to a second position adjacent the second end; a second non-conductive insert in which a pressure port is defined, said first and second inserts disposed in the housing so that the pressure port is in fluid communication with the piston cylinder; a first electrical contact in electrical contact with the piston; a second electrical contact adjacent the first end of the piston cylinder; a third electrical contact adjacent the second end of the piston cylinder; and wherein the piston is electrically conductive so as to allow current to flow from the first contact to the second contact or from the first contact to the third contact.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 1:
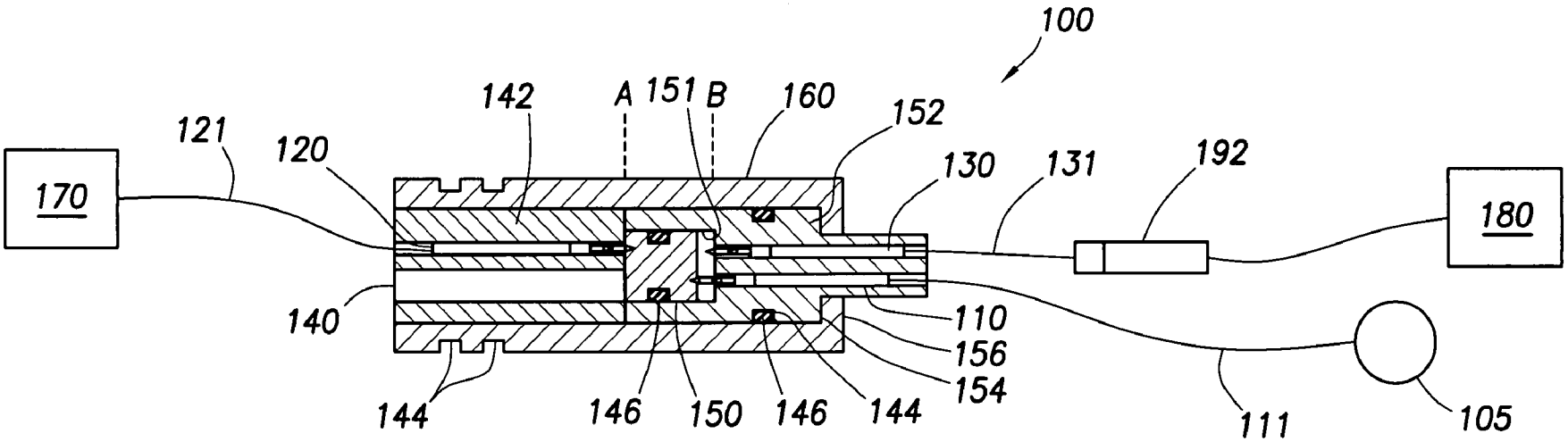
FIG. 1 illustrates a cross-sectional view of an electrical switch actuated by a pressure wave in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present application relates to pressure actuated electrical switches. More particularly, methods and devices are provided for arming successive explosive charges upon actuation of a switch by pressure waves from previous detonations.

Methods and devices of the present invention allow for the selected activation of a plurality of explosive charges of a perforation gun at desired depths. As one example of a pressure switch device of the present invention, a first set explosive charges may be armed while a second set of charges remain unarmed. Detonation of the first set of charges have the effect of arming the second set of charges and simultaneously disarming the first set of charges. Any multiple of charges may be used in this fashion where subsequent charges are armed by the previous detonation of other charges.

In certain embodiments, pressure switches of the present invention comprise a housing having a pressure port therein, a plurality of electrical contacts (e.g. pins), and a slidable piston. An electrically-conductive piston in the housing slides from a first position to a second position. A pressure port in the housing allows a pressure wave from a first detonation to induce axial displacement of the piston from a first position to a second position.

As will be explained further below, the movement of the piston electrically disengages the piston from one arming mechanism and electrically engages the piston with a subsequent arming mechanism.

Advantages of certain embodiments include, but are not limited to, a more reliable switching mechanism, operability over a larger range of conditions including a larger range of pressures and temperatures, and a decreased susceptibility to failures due to fluid leakages in the perforation gun. Fluid leakages can cause a number of problems including corrosion from corrosive fluids. Conductive fluids such as water may cause short circuit failures of switching mechanisms.

Although the pressure switches discussed herein are discussed in the context of their usefulness in perforation guns, it is explicitly recognized that the electrical pressure switches herein are adaptable to any application that would benefit from the use of a pressure actuated electrical switch.

To facilitate a better understanding of the present invention, the following examples of certain embodiments are given. In no way should the following examples be read to limit, or define, the scope of the invention.

FIG. 1 illustrates a cross-sectional view of an electrical switch actuated by a pressure wave in accordance with one embodiment of the present invention.

Pressure-actuated electrical switch 100 comprises housing 160, pressure port 140, first pin 110, second pin 120, third pin 130, and piston 150. Piston 150 is adapted to slide in piston cylinder 151 from first position A to second position B. Preferably, piston cylinder 151 is formed in a non-conducting block or insert 152 carried within housing 160. Piston 150 may be any shape suitable for displaying within piston cylinder 151, including, but not limited to cylindrical shaped.

As shown, first pin 110 and third pin 30 may also be mounted in insert 152. Moreover, insert 152 is characterized by a shoulder 154 which abuts corresponding shoulder 156 formed by housing 160. Pressure port 140 is likewise formed in a non-conducting block or insert 142. Second pin 120 may also be mounted in insert 142. Insert 142 is disposed in housing 160 so as to abut insert 152, permitting fluid communication between pressure port 140 and piston cylinder 151.

As can be seen in FIG. 1, when piston 150 is in first position A, piston 150 is in electrically engaged with first pin 110 and second pin 120, while third pin 130 is electrically disengaged with piston 50. Also, pressure switch 100 is further configured such that first pin 110 remains in electrical engagement with piston 150 regardless of whether piston 150 is in first position A or second position B.

Upon sufficient pressure imposed through pressure port 40, piston 150 is motivated to move from first position A to second position B. Upon piston 150 moving from first position A to second position B, piston 150 is electrically disengaged from second pin 120 also resulting in electrical disengagement between second pin 120 and first pin 110. Additionally, this movement of piston 150 from first position A to second position B also electrically engages third pin 130 with piston 150, which also electrically engages first pin 110 with third pin 130.

Since shoulder 154 abuts shoulder 156, insert 152 will remain secured in housing 160 under application of pressure from pressure port 140.

Such operation of switch 100 is particularly useful in the context of controlling activation of multiple-staged explosive charges. In such an application, first pin 110 is electrically connected to an arming power source 105 via hot wire 111, second pin 120 is electrically engaged with first explosive charge 170 via wiring 121, and third pin 130 is electrically engaged with a second explosive charge 180 via wiring 131. In this way, a pressure wave from a detonation of first explosive charge 170 acting through pressure port 140 motivates piston 150 to move from first position A to second position B. This movement from first position A to second position B electrically disengages the first explosive charge from the power source 105 (by electrically disengaging piston 50 from second pin 20) while simultaneously electrically engaging the power source 105 to second explosive charge 180 via third pin 30.

It is explicitly recognized that the pressure wave may act directly upon piston 150 through pressure port 140 or alternatively, may act indirectly upon piston 150 by acting upon a fluid which then acts directly on piston 150.

Figure 2:
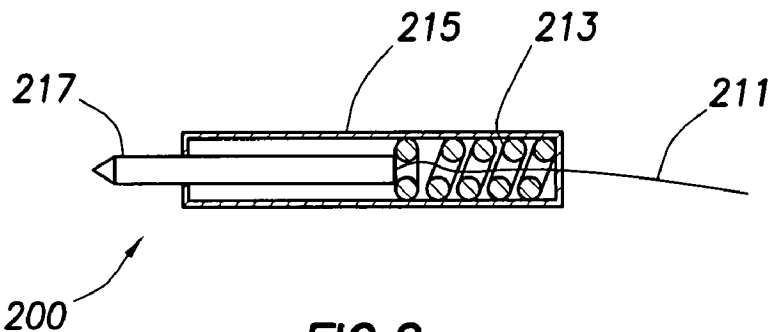
FIG. 2 illustrates a spring-loaded electrical contact.

Although the above described pins could take the form of any various types of electrical contacts, in the preferred embodiment, electrical pins 110, 120, 130 are spring-loaded pins carried in a cylinder, sometimes referred to as Pogo® pins. An example of a spring-loaded electrical contact is illustrated in FIG. 2. Electrical contact 200 comprises slender cylinder 215, which houses at least partially, electrically-conductive pin contact 217. Pin contact 217 is mechanically biased by spring 213 and is in electrical communication with wiring 211.

Returning to FIG. 1, first pin 110 and third pin 130 are disposed in a non-conducting block parallel to one another. However, first pin 110 is preferably slightly offset from third pin 130 so that the spring-loaded pin of first pin 110 is urged against piston 150 when piston 150 is in its first position. As piston 150 moves to second position B under pressure applied to the piston surface adjacent pressure port 140, the spring-loaded pin of first pin 110 is compressed. Those skilled in the art will appreciate that because first pin 10 is spring-loaded, it will compress while maintaining electrical contact with piston 150. Likewise, pins 120 and 130 are also spring-loaded so that the spring within the pins urges pins 120 and 130 into contact with piston 150 when piston 150 is in its first or second position, respectively.

In another embodiment, the pins or electrical contacts may simply be an electrically conductive plate fastened so as to extend into the piston cylinder. Such plate may even be bent, such as in the shape of a "v" to form a simple spring which compresses against the surface of the piston.

While the foregoing spring-loaded pins are the most desirable configuration for the invention, pins 120 and 130 could be replaced with fixed contacts extending into the cylinder in which the piston is mounted. Similarly, hot wire 111 could be hard wired to the piston 150, such as on the non-pressure piston surface. In yet another embodiment, hot wire 11 is disposed to extend from the side of the piston cylinder and electrically engage the side of piston 150, regardless of whether piston 150 is in its first position or second position. An electrical contact may be mounted in the wall of the piston cylinder for this purpose.

Optional diode 192 provides an additional limitation on the arming of the second explosive charge in that only a current of the correct polarity will be communicated through wiring 131.

Various o-ring grooves 144 may be disposed to carry o-rings 146 to permit sealing of various components described herein in a manner known in the art.

The foregoing pressure switch 100 may be incorporated into a perforating gun and disposed between consecutive explosive charges 170 and 180, which in certain embodiments may be blasting cap-perforating element assemblages.

Figure 3:
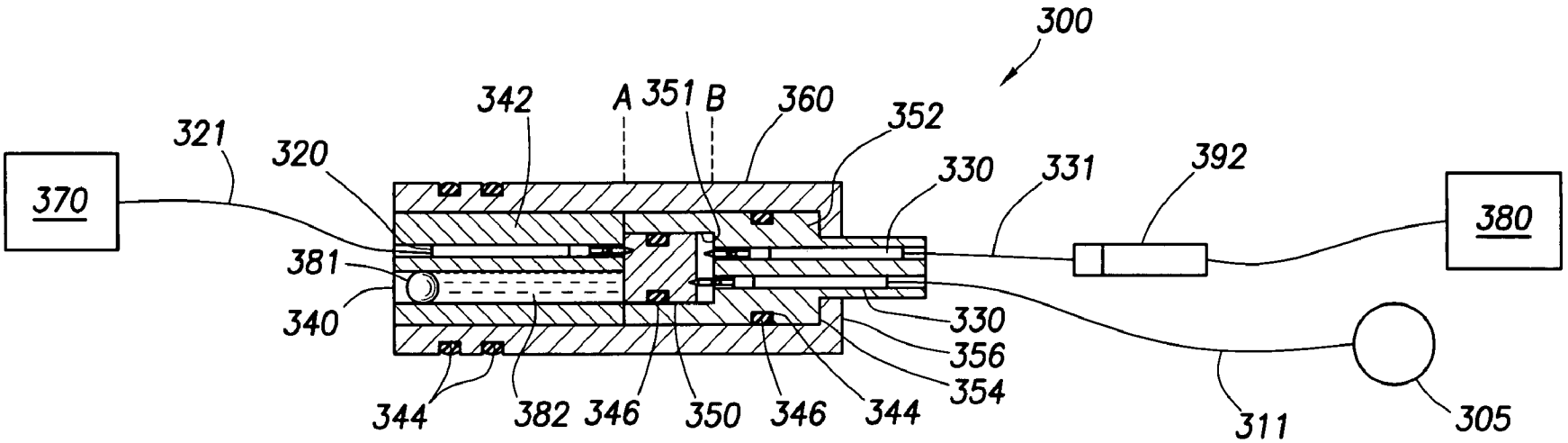
FIG. 3 illustrates a cross-sectional view of another embodiment of an electrical switch.

FIG. 3 illustrates a cross-sectional view of another embodiment of an electrical switch. Pressure-actuated electrical switch 300 is similar to pressure-actuated electrical switch 100, except that secondary piston 381 is disposed in pressure port 340.

Optional secondary piston 381 may be any object suitable for displacement through pressure port 340, including, but not limited to, a non-conducting piston, a seal ball, shaft, or combination thereof. Gel 382 or any flowable material may optionally be disposed in pressure port 340 between secondary piston 381 and piston 350. Gel 382 may be any non-conducting or dielectric gel including, but not limited to a silicone grease.

As before, a pressure wave from a preceding explosion is communicated through pressure port 340. Here, secondary piston 381 is displaced along the length of pressure port 340 and causes piston 350 to displace from first position A to second position B. Where 382 is present, secondary piston 381 transmit force through gel 382 to motivate piston 350 to displace from first position A to second position B.

The use of secondary piston 381 and/or gel 382 is advantageous to reduce the likelihood of a fluid leak into switch 300 by acting as a barrier to fluid entering pressure port 340.

In certain embodiments, secondary piston 381 will form an interference fit with pressure port 340. O-rings may further be disposed in pressure port 340 to form an improved seal of pressure port 340 against the undesirable entry of fluid. Gel 382 may be positively or negatively pressurized between secondary piston 381 and piston 350 in certain embodiments. Gaskets or other seals may be used to retain gel 382 within pressure port 340.

Figure 4A:
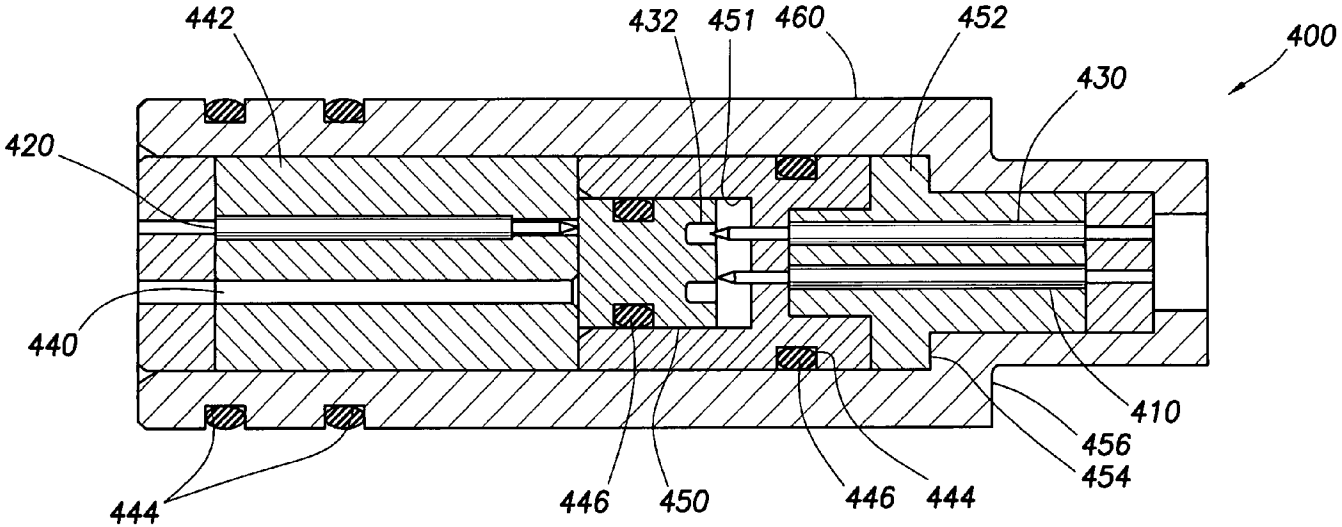
FIG. 4A illustrates a cross-sectional view of an electrical switch having a piston shown in a first position.
Figure 4B:
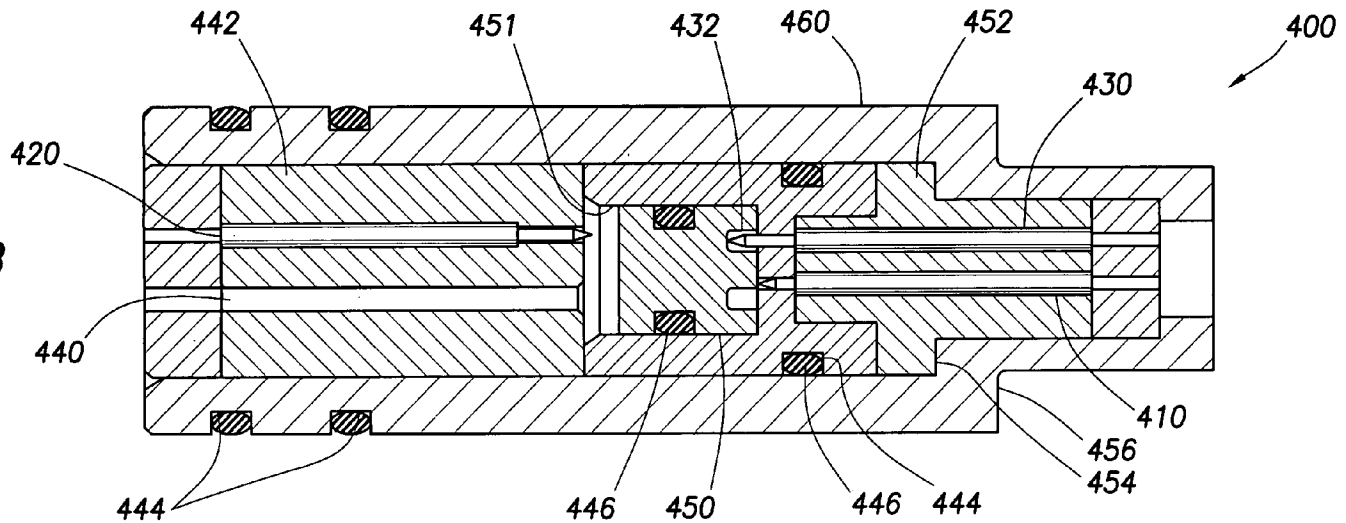
FIG. 4B illustrates a cross-sectional view of an electrical switch having a piston shown in a second position.

FIGS. 4A and 4B illustrate a cross-sectional view of an electrical switch having a piston shown in a first position and a second position. FIG. 4A shows piston 450 in first position A whereas FIG. 4B shows piston 450 in second position B.

Similar to the embodiments heretofore described, electrical contact 420 is in electrical communication with piston 450 when piston 450 is in first position A but not in second position B. Electrical contact 410 is in electrical communication with piston 450 regardless of the position of piston 450. Finally, electrical contact 430 is in electrical communication with piston 450 only when piston 450 is displaced to second position B.

In this way, piston 450 provides electrical communication between electrical contacts 410 and 420 when piston 450 is in first position A and between electrical contacts 410 and 430 when piston 450 is in second position B.

Inset 432 allows a configuration in which electrical contact 420 does not contact piston 450 when piston 450 is in first position A. Inset 432 may be any suitable geometric modification to piston 450 including, but not limited to, a notch, an indentation, or an aperture capable of ensuring that electrical contact 420 is not in contact with piston 450 when piston 450 is in first position A.

It is explicitly recognized that any of the features of the disclosed embodiment may be combined with one or more of the features of any other embodiment described herein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A switch for controlling detonations in a perforation gun comprising:

a housing;

a pressure port extending into the housing;

a piston disposed in the housing, the piston having a portion of its surface area exposed to the pressure port wherein the piston is configured to slide from a first position to a second position in the housing upon pressure being applied to the piston from the pressure port;

a first electrical contact disposed at least partially in the housing such that the first electrical contact is in electrical contact with the piston when the piston is in the first position and when the piston is in the second position;

a second electrical contact disposed at least partially in the housing such that the second electrical contact is in electrical contact with the piston when the piston is in the first position and not in electrical contact with the piston when the piston is in the second position;

a third electrical contact disposed at least partially in the housing such that the third electrical contact is in electrical contact with the piston when the piston is in the second position and not in electrical contact with the piston when the piston is in the first position;

wherein the piston is electrically conductive so as to allow current to flow from the first electrical contact to the second electrical contact or from the first electrical contact to the third electrical contact; and wherein the first electrical contact, the second electrical contact, and the third electrical contact are electrically conductive.

2. The switch of claim 1 wherein the first electrical contact and the third electrical contact are disposed on one end of the piston.

3. The switch of claim 2 wherein the first electrical contact and the second electrical contact are disposed on opposite ends of the piston.

4. The switch of claim 3 wherein housing and the piston are cylindrical.

5. The switch of claim 4 wherein the pressure port is adjacent the second electrical contact.

6. The switch of claim 1 wherein the first electrical contact and the second electrical contact are disposed on opposite ends of the piston.

7. An electrical switch actuated by pressure comprising:

a housing having a first end and a second end;

a piston disposed in the housing slidable from a first position to a second position, the piston having a first end and a second end;

a pressure port extending into the housing from the second end of the housing wherein the pressure port is at least partially exposed to the second end of the piston so as to cause the piston to slide from the first position to the second position upon an application of pressure to the second end of the piston;

a first pin disposed at least partially in the housing such that the first pin is in electrical contact with the first end of the piston when the piston is in the first position and when the piston is in the second position;

a second pin disposed at least partially in the housing such that the second pin is in electrical contact with the second end of the piston when the piston is in the first position and not in electrical contact with the piston when the piston is in the second position;

a third pin disposed at least partially in the housing such that the third pin is in electrical contact with the first end of the piston when the piston is in the second position and not in electrical contact with the piston when the piston is in the first position;

wherein the piston is electrically conductive so as to allow current to flow from the first pin to the second pin or from the first pin to the third pin; and wherein the first pin, the second pin, and the third pin are electrically conductive.

8. The switch of claim 7 wherein the first pin and the third pin are disposed on one side of the piston.

9. The switch of claim 8 wherein the first pin and the second pin are disposed on opposite ends of the piston.

10. The switch of claim 9 wherein housing and the piston are cylindrical.

11. The switch of claim 10 wherein the pressure port is adjacent the second pin.

12. The switch of claim 11 wherein the piston includes an insert adapted into which the third pin is adapted to fit so as to facilitate the piston not being in electrical contact with the third pin when the piston is in the first position.

13. The switch of claim 7 wherein the first pin and the second pin are disposed on opposite sides of the piston.

14. A method for arming a charge upon detection of a pressure wave comprising:

providing a pressure switch comprising a housing, a pressure port extending into the housing, a piston disposed in the housing wherein the piston has a portion of its surface area exposed to the pressure port wherein the piston is configured to slide from a first position to a second position in the housing upon pressure being applied to the piston from the pressure port, a first electrical contact disposed at least partially in the housing such that the first electrical contact is in electrical contact with the piston when the piston is in the first position and when the piston is in the second position, a second electrical contact disposed at least partially in the housing such that the second electrical contact is in electrical contact with the piston when the piston is in the first position and not in electrical contact with the piston when the piston is in the second position, a third electrical contact disposed at least partially in the housing such that the third electrical contact is in electrical contact with the piston when the piston is in the second position and not in electrical contact with the piston when the piston is in the first position wherein the piston is electrically conductive so as to allow current to flow from the first electrical contact to the second electrical contact or from the first electrical contact to the third electrical contact, and wherein the first electrical contact, the second electrical contact, and the third electrical contact are electrically conductive;

detonating an explosive charge to generate a pressure wave;

directing said pressure wave through said pressure port; and utilizing the directed pressure wave to slide the piston from the first position to the second position so as to disengage electrical contact between the first electrical contact and the second electrical contact and to engage electrical contact between the first electrical contact and the third electrical contact.

15. The method of claim 14 further comprising providing a gel in a portion of the pressure port and allowing the pressure wave to cause the gel to induce the piston to slide from the first position to the second position.

16. The method of claim 14 further comprising providing a secondary piston disposed in the pressure port and allowing the pressure wave to cause the secondary piston to induce the piston to slide from the first position to the second position.

17. The method of claim 14 further comprising providing a secondary piston disposed in the pressure port and providing a gel in a portion of the pressure port between the secondary piston and the piston.

18. The method of claim 17 wherein the secondary piston is a ball and further comprising sealing the pressure port with a gasket.

19. The method of claim 14 further comprising providing a flowable material in a portion of the pressure port and allowing the pressure wave to cause the flowable material to induce the piston to slide from the first position to the second position.

20. The method of claim 14 wherein the first electrical contact and the third electrical contact are disposed on one side of the piston.

21. The method of claim 14 wherein the first electrical contact and the second electrical contact are disposed on opposite sides of the piston.

22. The method of claim 21 wherein the first electrical contact and the second electrical contact are disposed on opposite sides of the piston.

23. The method of claim 22 wherein housing and the piston are cylindrical.

24. The method of claim 23 wherein the pressure port is adjacent the second electrical contact.

25. The method of claim 14 wherein the first electrical contact electrically connects to a first arming mechanism for a first explosive charge.

26. The method of claim 15 wherein the first electrical contact electrically connects to a power source.

27. The method of claim 26 wherein the third electrical contact electrically connects to a second arming mechanism for a second explosive charge.

28. The method of claim 26 wherein the second electrical contact and the third electrical contact are spring-loaded pins.

29. A switch for controlling detonations in a perforation gun comprising:

a housing;

a first non-conductive insert in which a piston cylinder is formed, said cylinder having a first end and a second end;

a piston slidingly disposed in said piston cylinder and movable from a first position adjacent the first end to a second position adjacent the second end;

a second non-conductive insert in which a pressure port is defined, said first and second inserts disposed in the housing so that the pressure port is in fluid communication with the piston cylinder;

a first electrical contact adjacent the piston cylinder;

a second electrical contact adjacent the first end of the piston cylinder;

a third electrical contact adjacent the second end of the piston cylinder;

wherein the piston is electrically conductive so as to allow current to flow from the first contact to the second contact or from the first contact to the third contact.

30. The switch of claim 29 wherein said electrical contacts are spring mounted electrical pins.

31. The switch of claim 29 wherein said first electrical contact is fastened to said piston.

32. A perforating gun comprising:

a first blasting cap;

a second blasting cap;

a switch disposed between said blasting caps, said switch comprising:

a switch housing;

a first non-conductive insert in which a piston cylinder is formed, said cylinder having a first end and a second end;

a piston slidingly disposed in said piston cylinder and movable from a first position adjacent the first end to a second position adjacent the second end;

a second non-conductive insert in which a pressure port is defined, said first and second inserts disposed in the housing so that the pressure port is in fluid communication with the piston cylinder;

a first electrical contact in electrical contact with the piston;

a second electrical contact adjacent the first end of the piston cylinder;

a third electrical contact adjacent the second end of the piston cylinder; and wherein the piston is electrically conductive so as to allow current to flow from the first contact to the second contact or from the first contact to the third contact.

33. The perforating gun of claim 32 wherein said second electrical contact is in electrical communication with said first blasting cap and said third electrical contact is in fluid communication with said second blasting cap.

* * * * *